United States Patent [19]

Steele et al.

[11] Patent Number: 4,613,993

[45] Date of Patent: Sep. 30, 1986

[54] PROTECTIVE HEAD GEAR WITH TUBULAR RINGS

[76] Inventors: Richard J. Steele; Maribel Steele, both of 2202 Harwell, Houston, Tex. 77023

[21] Appl. No.: 686,913

[22] Filed: Dec. 27, 1984

[51] Int. Cl.[4] ..... A63B 71/10

[52] U.S. Cl. ..... 2/411; 112/421; 112/425

[58] Field of Search ..... 2/421, 410, 411, 412, 2/414, 416, 425, 2, 175, 198; 112/63, 139

[56] References Cited

U.S. PATENT DOCUMENTS

| | | | |
|---|---|---|---|
| 1,256,594 | 2/1918 | Rodal | 2/2 |
| 1,868,926 | 7/1932 | Tatone et al. | 2/425 X |
| 2,199,427 | 5/1940 | Dohen | 2/198 |
| 2,594,478 | 4/1952 | Moore | 2/421 X |
| 2,706,294 | 4/1955 | Sprinkle | 2/414 |
| 2,747,196 | 5/1956 | Kaye | 2/175 |
| 2,879,513 | 3/1959 | Hornickel et al. | 2/414 |
| 2,886,818 | 5/1959 | Roberts | 2/421 |
| 4,343,047 | 8/1982 | Lazowski et al. | 2/411 |

FOREIGN PATENT DOCUMENTS

| | | | |
|---|---|---|---|
| 670413 | 2/1936 | Fed. Rep. of Germany | 2/2 |
| 945412 | 12/1963 | United Kingdom | 2/414 |

*Primary Examiner*—Werner H. Schroeder
*Assistant Examiner*—Andrew M. Falik
*Attorney, Agent, or Firm*—Ranseler O. Wyatt

[57] ABSTRACT

A protective head gear comprising a plurality of concentric tubular rings formed of soft, yieldable material. The rings which are filled with non-flamable, light, yieldable material, are gradually reduced diametrically and joined by flexible ribbons. A chin strap and a rear support strap detachably maintain the rings on the head of the user.

1 Claim, 2 Drawing Figures

PROTECTIVE HEAD GEAR WITH TUBULAR RINGS

BACKGROUND OF THE INVENTION

Children are prone to head injuries, such infants, while learning to walk, and as they grow older, in their active play and when riding in automobiles subject to accidental collisions or sudden stops, head injuries are to be expected. Head gear such as helmets worn by football players, and the like, are heavy, cumbersome and, particularly for infants, uncomfortable.

PRIOR ART

A patent to Dye, U.S. Pat. No. 2,969,547, on a Protective Head Covering appears to be generally for the same purpose as Applicant's invention, although this patent does not afford the protection for the head, particularly the crown, in the way this application discloses, nor does it employ concentric rings.

Neis, U.S. Pat. No. 3,555,561 does show tubular members, but they are not rings and the helmet shown in this patent would be clumsy and is not designed for use by infants, but for the handicapped.

SUMMARY OF THE INVENTION

A protective head gear having a series of gradually diametrically reduced concentric rings of light, flexible, tubular material, detachably secured to the head of the user, with a reinforcing strip mounted in the largest ring and means for connecting said rings to each other, to provide a light, comfortable, attractive head gear.

DESCRIPTION OF THE PREFERRED EMBODIMENT

Figure 1:
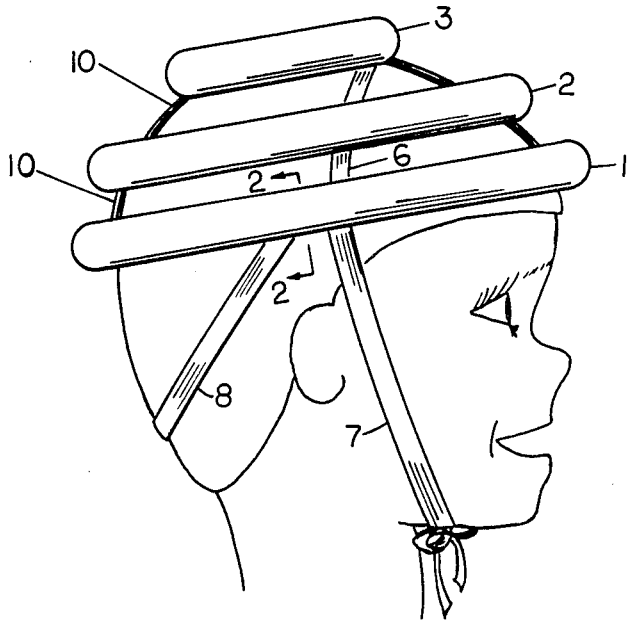
FIG. 1 is a side elevational view of the device mounted on the head of a user.
Figure 2:
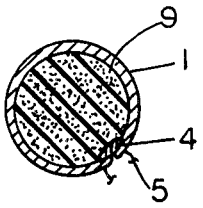
FIG. 2 is a cross sectional view of a tubular member employed, taken on the line 2—2 of FIG. 1.

In the drawings the numerals 1, 2, 3 designate a plurality of tubular concentric rings of decreasing diameter, which are filled with a suitable, yieldable material 9, such as a polyester, which is flameproof, yieldable and of light weight. The lower-most ring 1 is reinforced with a strip 4 of the same material as the ring, mounted over the longitudinal edges of the material forming the tubes and bound by the seam 5 which passes through the material forming tubes and the reinforcing strip 4. The strip 4 is located on the inside of the ring by the conventional turning of the ring inside-out after the strip is initially sewn over the said longitudinal edges on the outside of the ring.

The rings are maintained in spaced relation on the head by means of the side and rear connecting ribbons 6 and 10. A rear support strap 8 and a chin strap 7 maintain the protective head gear on the wearer's head.

The material from which the tubular rings are made may be of any soft, light fabric, such as cotton, with the rear support strap 8 holding the rings against forward movement and the chin strap 7 holding the rings against rearward movement. The side ribbons 6 are anchored at one end to the lower most ring adjacent one end of the said chin strap. They are directed upwardly and forwardly at an angle and anchored to the second ring and continue from the second ring to the third or top ring. The rear connecting ribbon extends in a line from the lowermost ring to the second and third rings.

The large, soft rings guard against injury to the skull from a fall or blow of any kind. It is contemplated that this device will be in various sizes to permit use by infants as well as older children, and that adults may also use this device or protection against blows when engaged in various activities, such as sports, or riding in a vehicle.

What we claim is:

1. In a protective head gear a plurality of concentric rings of light, flexible material, ribbons connecting said rings in spaced relationship, and means for maintaining said rings on the head of a user, said rings being tubular and gradually diametrically reduced, with the lowermost ring being the largest, a reinforcing strip of light, flexible material mounted on the inside of the largest of said rings and covering a seam located thereon, said connecting ribbons comprising side ribbons and a rear ribbon wherein said side ribbons extend upwardly and forwardly from the lowermost ring to a top ring and the rear ribbon extends in a line from the top ring to the lower ring, the said maintaining means comprising a chin strap and a rear support strap.

* * * * *